US006559415B1

(12) United States Patent
Mannava et al.

(10) Patent No.: US 6,559,415 B1
(45) Date of Patent: May 6, 2003

(54) SINGLE SIDED LASER SHOCK PEENING

(75) Inventors: SeethaRamaiah Mannava, Cincinnati, OH (US); Philemon Kennard Wright, III, Cincinnati, OH (US); Farzin Homayoun Azad, Clifton Park, NY (US); Mark Lloyd Miller, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/195,095

(22) Filed: Jul. 12, 2002

(51) Int. Cl.[7] ..... B23K 26/00
(52) U.S. Cl. ..... 219/121.85
(58) Field of Search ..... 219/121.85, 121.73, 219/121.75, 121.68, 121.69; 148/525, 565

(56) References Cited

U.S. PATENT DOCUMENTS 4,401,477 A * 8/1983 Clauer et al.
5,131,957 A * 7/1992 Epstein et al.
5,531,570 A * 7/1996 Mannava et al.
5,591,009 A * 1/1997 Mannava et al.
5,674,328 A * 10/1997 Mannava et al.
5,674,329 A * 10/1997 Mannava et al.
5,911,890 A * 6/1999 Dulaney et al.
5,932,120 A * 8/1999 Mannava et al.
5,948,293 A * 9/1999 Somers et al.
6,078,022 A * 6/2000 Dulaney et al.
6,343,502 B1 * 2/2002 Subhash et al.
6,412,331 B1 * 7/2002 Clauer et al.
6,462,308 B1 * 10/2002 Lahrman et al.
2001/0042397 A1 * 11/2001 Clauer et al.

* cited by examiner

*Primary Examiner*—Tom Dunn
*Assistant Examiner*—Jonathan Johnson
(74) *Attorney, Agent, or Firm*—V. G. Ramaswamy; Steven J. Rosen

(57) ABSTRACT

A method for single sided laser shock peening an article includes laser shock peening a laser shock peening surface on a first side of the article while maintaining an opposite second surface on a back side of the article in acoustic communication with a shock attenuating material. The second surface is opposite the laser shock peening surface. The shock attenuating material is a material that does not allow tensile waves to be reflected back off the back side through the article. The shock attenuating material may be a liquid metal and the article made from a titanium alloy. One such article is a gas turbine engine airfoil of an integrally bladed disk and the surfaces may be on an edge of the airfoil. The shock attenuating material may be one that dissipates compressive waves or reflects back compressive shock waves caused by the laser shock peening.

46 Claims, 5 Drawing Sheets

SINGLE SIDED LASER SHOCK PEENING

BACKGROUND OF THE INVENTION

1. Field of the Invention

This invention relates to laser shock peening and, more particularly, to methods for laser shock peening a single side of an article.

2. Description of Related Art

Laser shock peening or laser shock processing, as it is also referred to, is a process for producing a region of deep compressive residual stresses imparted by laser shock peening a surface area of an article. Laser shock peening typically uses one or more radiation pulses from high power pulsed lasers to produce an intense shock wave at the surface of an article similar to methods disclosed in U.S. Pat. No. 3,850,698 entitled "Altering Material Properties"; U.S. Pat. No. 4,401,477 entitled "Laser Shock Processing"; and U.S. Pat. No. 5,131,957 entitled "Material Properties". Laser shock peening, as understood in the art and as used herein, means utilizing a pulsed laser beam from a laser beam source to produce a strong localized compressive force on a portion of a surface by producing an explosive force at the impingement point of the laser beam by an instantaneous ablation or vaporization of a thin layer of that surface or of a coating (such as tape or paint) on that surface which forms a plasma.

Laser shock peening is being developed for many applications in the gas turbine engine field, some of which are disclosed in the following U.S. Pat. No. : 5,756,965 entitled "On The Fly Laser Shock Peening"; U.S. Pat. No. 5,591,009 entitled "Laser shock peened gas turbine engine fan blade edges"; U.S. Pat. No. 5,531,570 entitled "Distortion control for laser shock peened gas turbine engine compressor blade edges"; U.S. Pat. No. 5,492,447 entitled "Laser shock peened rotor components for turbomachinery"; U.S. Pat. No. 5,674,329 entitled "Adhesive tape covered laser shock peening"; and U.S. Pat. No. 5,674,328 entitled "Dry tape covered laser shock peening", all of which are assigned to the present Assignee.

Laser peening has been utilized to create a compressively stressed protective layer at the outer surface of an article which is known to considerably increase the resistance of the article to fatigue failure as disclosed in U.S. Pat. No. 4,937,421 entitled "Laser Peening System and Method". These methods typically employ a curtain of water flowed over the article or some other method to provide a plasma confining medium. This medium enables the plasma to rapidly achieve shock wave pressures that produce the plastic deformation and associated residual stress patterns that constitute the LSP effect. The curtain of water provides a confining medium, to confine and redirect the process generated shock waves into the bulk of the material of a component being LSP'D, to create the beneficial compressive residual stresses.

The pressure pulse from the rapidly expanding plasma imparts a traveling shock wave into the component. This compressive shock wave caused by the laser pulse results in deep plastic compressive strains in the component. These plastic strains produce residual stresses consistent with the elastic modulus of the material. Dual sided simultaneous laser shock peening includes simultaneously striking both sides of an article by two laser beams in order to increase the compressive residual stress in the material. The laser beams are typically balanced in order to minimize material distortion. There are some applications for single sided laser shock peening. The initial compressive waves pass through the material from each of the sides and are reflected back from the interface of the two initial compressive waves. The reflected waves turn into a tension wave. The reflected tension waves from both sides can meet at a mid-plane in the same axial direction and reinforce each other leading to a high level of stress at the mid-plane.

There are some applications like airfoil leading edges of blisks where only one side of the article is easily accessible with a laser beam. A single sided LSP processing would be very useful but the compressive shock (stress) wave traveling through the metallic article is reflected from the other side of the article and returns as a tensile stress wave. The reversal of the stress from compressive to tensile is caused by the lower shock impedance of the adjoining material (usually room air). The returning tensile stress wave tends to undo at least a portion of the beneficial effects of the original compressive wave, i.e. lowering the amount of compressive residual stress imparted by the laser shock peening.

Thus, it is highly desirable to have a single sided laser shock peening process that avoids reduction or loss of effectiveness of the beneficial compressive strains from laser shock peening caused by reflected tensile waves.

SUMMARY OF THE INVENTION

A method for single sided laser shock peening an article includes laser shock peening a laser shock peening surface on a first side of the article while maintaining an opposite second surface on a back side of the article in acoustic communication with a shock attenuating material. The second surface is opposite the laser shock peening surface. The shock attenuating material is a material that does not allow tensile waves to be reflected back off the back side through the article. The shock attenuating material is a material that has a shock impedance equal or higher than that of the article.

The shock attenuating material may be a liquid metal and the article made from a titanium alloy. One such article is a gas turbine engine airfoil and the surfaces may be on an edge of the airfoil. A particular embodiment of the invention includes single sided laser shock peening a leading edge of the airfoil. The airfoil may be part of an integrally bladed disk. One liquid metal is mercury.

Another shock attenuating material is a solid attenuating material and a liquid metal interface, such as mercury, may be disposed between the article and the solid attenuating material. The shock attenuating material may be one that dissipates compressive waves caused by the laser shock peening. Another type of the shock attenuating material reflects back compressive shock waves caused by the laser shock peening through the back side of the article.

The liquid shock attenuating material or liquid metal interface may also be a slurry formed by mixing a suitable amount of metallic particles with a carrier liquid to achieve the desired shock impedance. Examples of such metallic particles are copper, brass or tungsten and one example of a suitable liquid carrier is a non-corrosive lubricant.

DETAILED DESCRIPTION OF THE INVENTION

Figure 1:
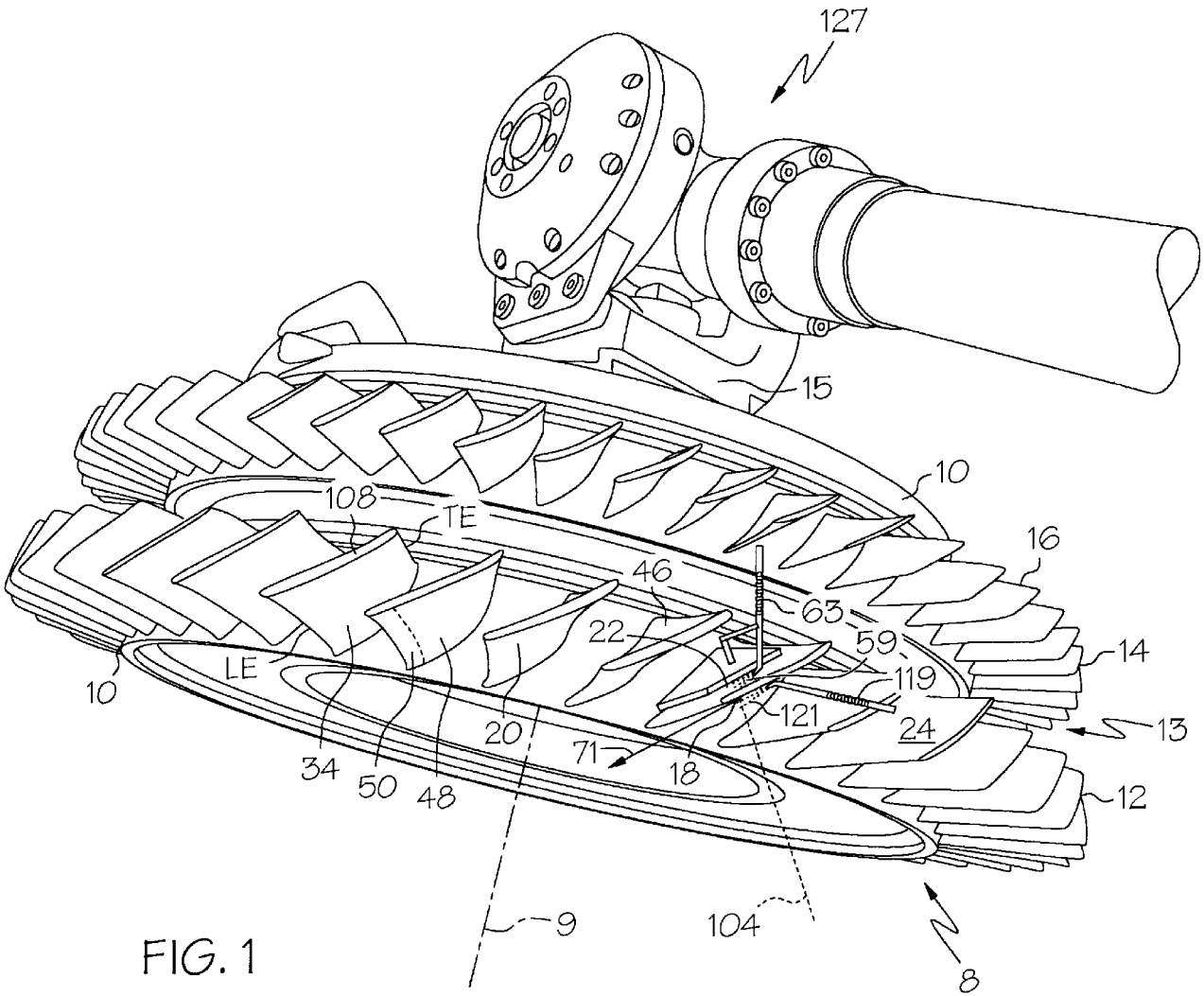
FIG. 1 is a diagrammatic perspective view illustration of an exemplary method for single sided laser shock peening of first stage compressor blades of an aircraft gas turbine engine BLISK.
Figure 2:
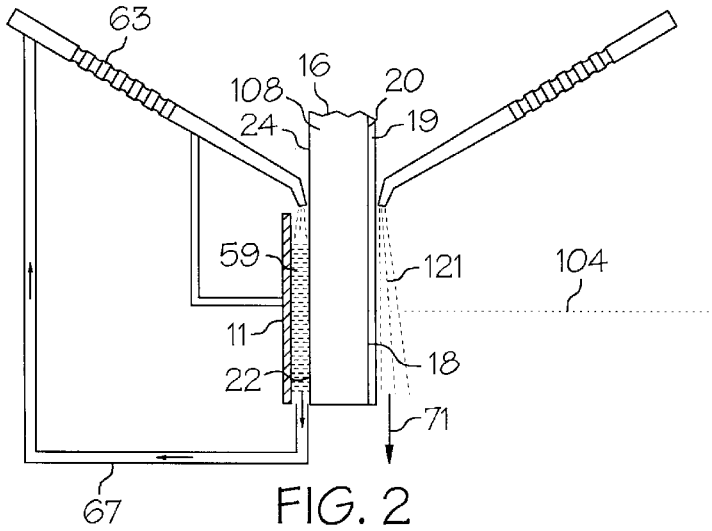
FIG. 2 is a cross-sectional view illustration of the exemplary method for single sided laser shock peening of first stage compressor blade illustrated in FIG. 1.

Illustrated in FIGS. 1 and 2 is a method and apparatus used for single sided laser shock peening a metallic article 16 such as a compressor blade 108. A laser shock peening surface 18 on a first side 20 of the article 16 is laser shock peened while maintaining an opposite second surface 22 on an opposite or back side 24 of the article 16 in acoustic communication with a shock attenuating material 59 that does not allow tensile waves to be reflected back off the back side 24 through the article 16. The opposite second surface 22 is opposite the first surface 18. A laser beam 104 is fired through a containment medium such as a curtain of water 121 on the laser shock peening surface 18 which is coated with an ablative coating 19 such as paint or adhesive tape to form coated surfaces as disclosed in U.S. Pat. Nos. 5,674,329 and 5,674,328. The coating 19 provides an ablative medium preferably over which is the clear containment medium which can be a fluid curtain such as a curtain of flowing water 121.

The shock attenuating material 59 that does not allow tensile waves to be reflected back off the back side 24 through the article 16 may either dissipate compressive waves caused by the laser shock peening or reflect compressive waves caused by the laser shock peening back through the article 16. The shock attenuating material 59 may be in direct contact or in acoustic communication with the article 16. In one embodiment of the invention, the shock attenuating material 59 has same shock impedance as the metal of the article, e.g. metal of a gas turbine engine blade and, thus, the shock is transmitted into the attenuating material 59, without reflection, and is dissipated within. Alternatively, embodiment of the shock attenuating material 59 has a greater shock impedance than the metal of the article 16 and reflects back a compressive shock wave through back side 24 of the article.

The shock attenuating material 59 with the same shock impedance dissipates the compressive shock wave after it passes through the article and, thus, eliminates the undesirable reflected tensile wave. Alternatively, the shock attenuating material 59 with higher shock impedance would cause the reflected wave to be compressive and, therefore, beneficial to the process because it would induce compressive residual stresses in the article as it reflects back through the article. In either case, the shock attenuating material 59 is placed in intimate contact or acoustic communication with the back side of the article. In FIGS. 1 and 2, the liquid shock attenuating material 59 supplied by a shock attenuating material nozzle 63 is held against, in direct contact, and in acoustic communication with the article 16 by a confining means, illustrated as a wall 11, for confining a liquid version of the shock attenuating material 59 on the opposite second surface 22 essentially without any air gaps between the surface and the wall 11.

Figure 3:
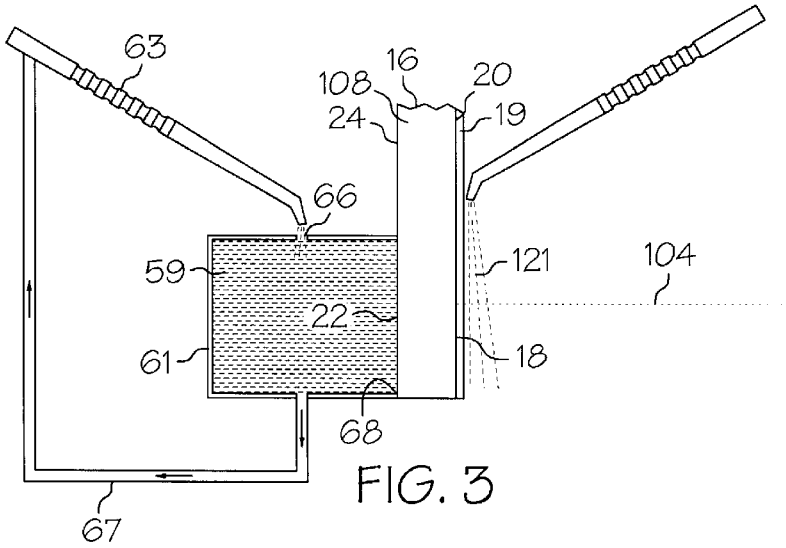
FIG. 3 is a cross-sectional view illustration of a first alternative method for single sided laser shock peening of an article such as the first stage compressor blade illustrated in FIG. 1.

Illustrated in FIG. 3 is a different type of confining means. The confining means in FIG. 3 is an enclosure 61 which receives the liquid shock attenuating material 59 through an inlet 66 and has an opening 68 which fits around the article 16. The liquid shock attenuating material 59 is held against, in direct contact with, and in acoustic communication with the article 16.

Figure 4:
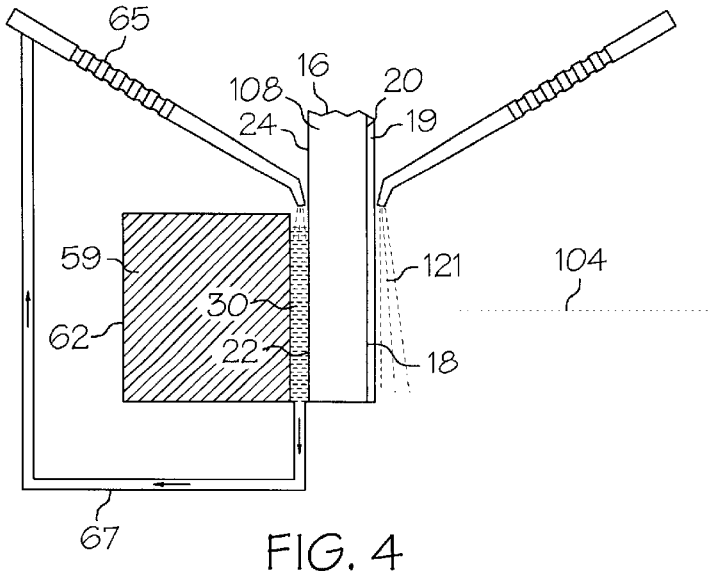
FIG. 4 is a cross-sectional view illustration of a second alternative method for single sided laser shock peening of an article such as the first stage compressor blade illustrated in FIG. 1.

If the attenuating material is a solid and intimate contact cannot be made directly with the material, a thin layer of liquid interface 30, as illustrated in FIG. 4, may be used between the first side and the back side of the article and the solid shock attenuating material 59. An alternative to the thin layer of liquid interface 30 is a thin layer of a pliable material that will not substantially alter the transmission of the shock to solid shock attenuating material 59 or reflect the shock back through the article 16. The confining means uses a solid shock attenuating material 59 in the form of a block 62 to hold the liquid interface 30 supplied by a liquid interface nozzle 65 against, in direct contact, and in acoustic communication with the article 16. The liquid interface 30 is thus held on the opposite second surface 22 essentially without any air gaps between the surface and the block 62 of the solid shock attenuating material 59. The shock attenuating material 59 may be a liquid such as mercury for use with an article made of a titanium alloy. If a solid shock attenuating material 59 is used, then mercury may be a suitable material for the liquid interface 30.

Alternatively, the liquid shock attenuating material 59 or the liquid interface 30 may be a slurry having particles of a suitable metal (for example, copper) which would effectively have the same or greater shock impedance than the metal of the article. The liquid shock attenuating material 59 or the liquid metal interface 30 may also be a slurry formed by mixing a suitable amount of metallic particles with a carrier liquid to achieve the desired shock impedance. Examples of such metallic particles are copper, brass or tungsten and one example of a suitable liquid carrier is a noncorrosive lubricant.

The use of the shock attenuating material 59 eliminates an undesirable tensile reflected wave or, alternatively, produces a desirable compressive reflected wave in one sided laser shock peening. The liquid shock attenuating material 59 or the liquid interface 30 may be collected and recirculated during the laser shock peening process as illustrated by return drains 67.

Figure 5:
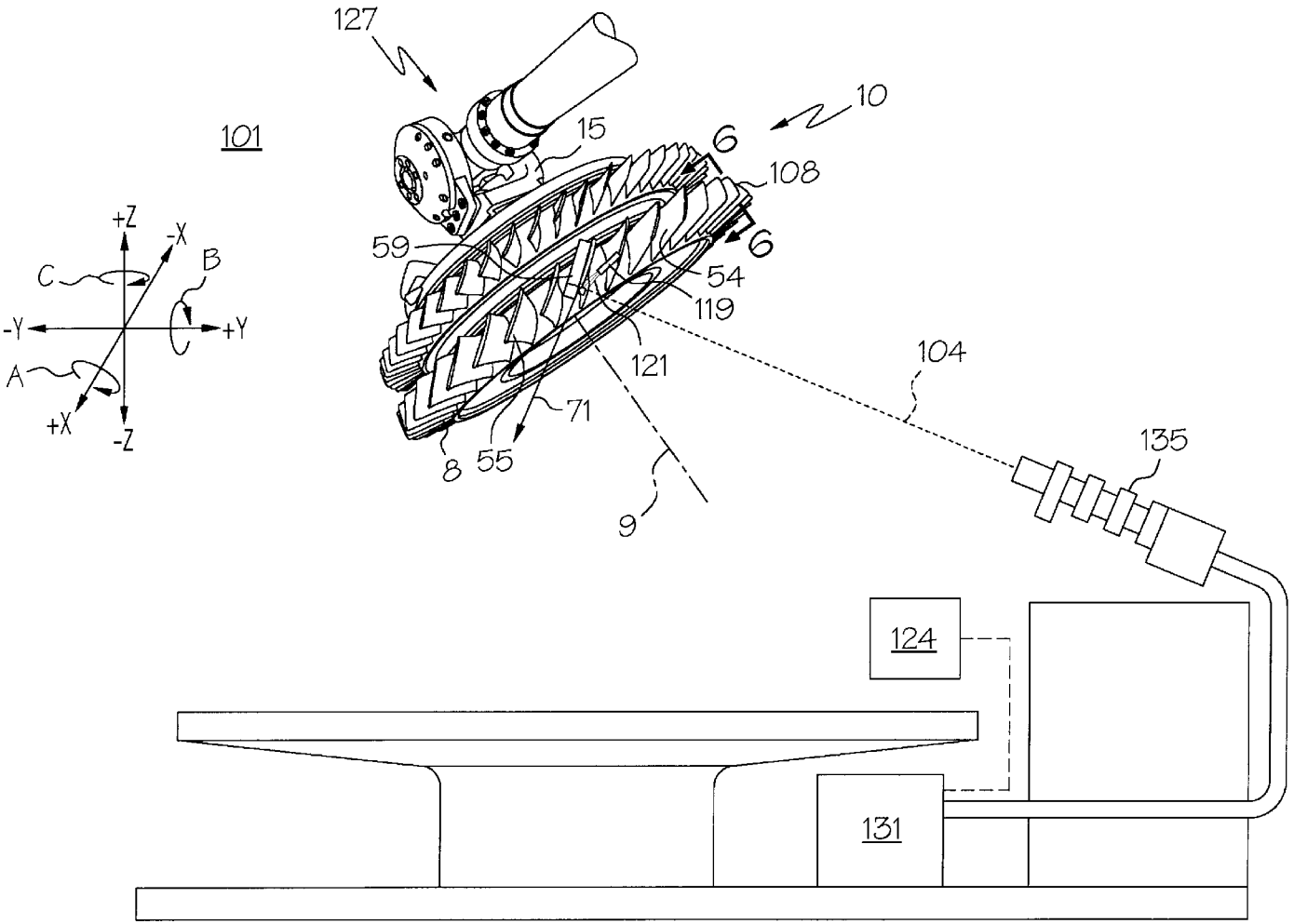
FIG. 5 is a partially diagrammatic and partially schematic view illustration of a laser shock peening apparatus and a third alternative method for laser shock peening the article such as the first stage compressor blade illustrated in FIG. 1.

The method and apparatus of the invention is illustrated in FIGS. 1 and 5 for use in laser shock peening the blade 108 of a bladed rotor section 8 having an axis of rotation 9 which coincides with a centerline of the engine about exemplified by an integrally bladed disk, referred to as a BLISK 10, having axially spaced apart circumferential forward and aft rows 12 and 14, respectively, (also referred to as first and second stages) of compressor blades 108. An annular space 13 extends between the axially adjacent spaced apart forward and aft rows 12 and 14 of the blades 108.

A BLISK 10 is illustrated as mounted in a fixture 15 which is attached to a six-axis computer numerically controlled (CNC) manipulator 127. The manipulator 127 is part of a single sided laser shock peening apparatus and system 101 which is illustrated more particularly in FIG. 5. The invention is not limited to rotor blades, including fan and turbine blades as well as compressor blades, and can be used for single sided laser shock peening various metallic articles.

Figure 8:
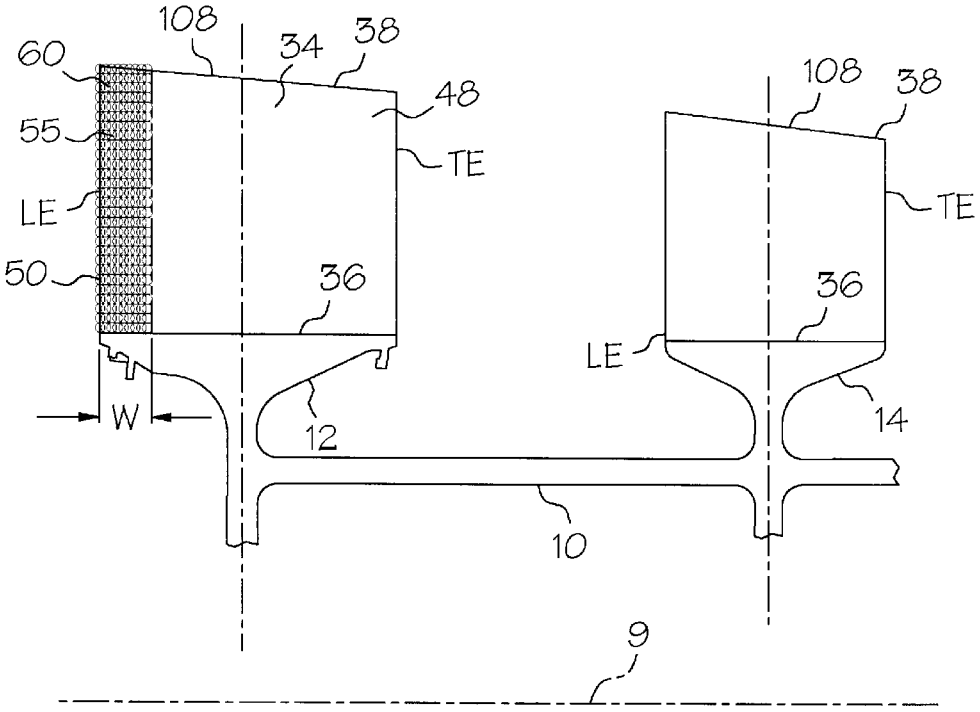
FIG. 8 is a side elevated view illustration of laser shock peened surface of the first stage compressor blades in FIG. 1.

The blade 108 is further illustrated in FIGS. 5, 6, 7, and 8 as having a suction side surface 55 as the first side which is single sided laser shock peened within a laser shock peened patch 145 along a leading edge LE of the blade 108 as particularly illustrated in FIG. 8. The suction side surface 55 is laser shock peened with the laser beam 104 while the back side represented by a pressure side surface 54 of the blade 108 is in direct contact or acoustic communication with the shock attenuating material 59.

Illustrated in FIGS. 5, 6, 7, and 8 is a third alternative embodiment of the shock attenuating material 59. A liquid version of the shock attenuating material 59 is enclosed in a thin flexible container 61. Walls of the thin flexible container 61 have to be pliable enough to conform to the metal article 16, in this case the blade 108, and also not interfere or at least not consequentially interfere with the transmission of the compressive waves from the laser shock peening through the metallic article and into the liquid shock attenuating material 59.

Figure 6:
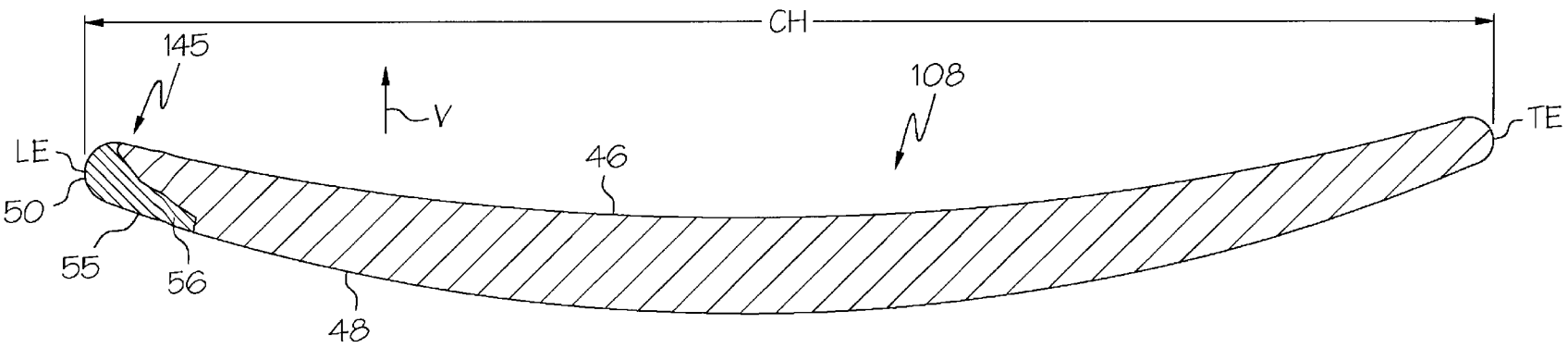
FIG. 6 is a cross-sectional view illustration of the first stage compressor blade taken through 6—6 in FIG. 5.
Figure 7:
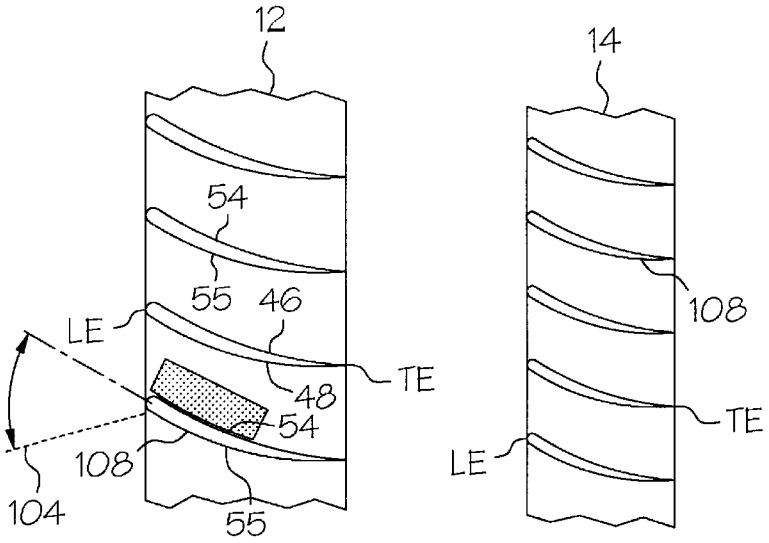
FIG. 7 is an elevated view illustration of a container of liquid shock attenuating material in contact with one of the first stage compressor blades in FIG. 5.

Referring to FIGS. 1, 6, and 8, each compressor blade 108 has an airfoil 34 extending in the chordwise direction between a leading edge LE and a trailing edge TE of the airfoil. A chord CH of the airfoil 34 is the line between the leading LE and trailing edge TE at each cross-section of the blade as illustrated in FIG. 6. Pressure and suction sides 46 and 48, respectively, of the airfoil 34 extend between the leading edge LE and trailing edge TE of the airfoil. The pressure side 46 faces in the general direction of rotation as indicated by arrow V and the suction side 48 is on the other side of the airfoil.

The blade 108 has a leading edge section 50 that extends along the leading edge LE of the airfoil 34 from a base 36 of the airfoil to a tip 38 of the airfoil. The leading edge section 50 has a width W such that the leading edge section 50 encompasses nicks and tears that may occur along the leading edge of the airfoil 34. The airfoil 34 subject to a significant tensile stress field due to centrifugal forces generated by the blade 108 rotating during engine operation. The airfoil 34 is also subject to vibrations generated during engine operation and the nicks and tears operate as high cycle fatigue stress risers producing additional stress concentrations around them.

The laser shock peened patch 145 is placed along a portion of the leading edge LE where the incipient nicks and tears may cause a failure of the blade due to high cycle fatigue. Laser shock peening imparts the pre-stressed regions 56 having deep compressive residual stresses which acts to counter fatigue failure of portions of the blade along possible crack lines that can develop and emanate from the nicks and tears.

The laser beam 104 is fired normal to or at an oblique angle with respect to a tangent 71 to the suction side surface 55 at a point where the laser beam 104 hits the suction side surface 55. The laser beam is fired with sufficient energy to form a pre-stressed region 56 having compressive residual stresses imparted by the laser shock peening extending into the article 16 from the suction side surface. The laser beam firing produces laser spots 60, as illustrated in FIG. 8, on the suction side surface and from which the pre-stressed region 56 of compressive residual stresses extends into the blade 108.

Illustrated in FIGS. 2, 3 and 6 is an exemplary embodiment of a single sided laser shock peening apparatus and method for laser shock peening the leading edge LE of the gas turbine engine blades 108 mounted on a rotor element illustrated as the BLISK 10. The method is illustrated for the leading edges LE of the forward row 12 of the compressor blades 108 but may be used with any metallic article. In the exemplary embodiment of the invention, overlapping adjacent ones of the laser spots 60 are formed in different linear passes of the laser beam 104 over the suction side surface 55 such that every other laser spot 60 is laser shock peened in the same pass.

The compressor blade 108 is mounted in the fixture 15 which is attached to the six-axis computer numerically controlled (CNC) manipulator 127 as illustrated in FIG. 5. Six axes of motion illustrated in the exemplary embodiment are conventional X, Y, and Z translational axes labelled X, Y, and Z, respectively, in FIG. 5 and conventional A, B, and C rotational axes labelled A, B, and C, respectively, all of which are well known in CNC machining. The manipulator 127 moves and positions the blades 108. The laser shock peening system 101 has a conventional laser beam generator 131 with an oscillator, a pre-amplifier, an optical transmission circuit having an amplifier, and optics 135 which include optical elements that transmit and focuses the laser beam 104 on the coated surface of the blade 108.

Before being laser shock peened to form the laser shock peened patch 145, the suction side surface 55 is coated with an ablative coating such as paint or adhesive tape to form coated surfaces as disclosed in U.S. Pat. Nos. 5,674,329 and 5,674,328. The coating provides an ablative medium preferably over which is a clear containment medium which may be a clear fluid curtain such as the curtain of flowing water 121. Between passes along the same row of the laser spots 60, the suction side surface 55 is recoated such that there is always an ablative coating over the surface being laser shock peened.

The laser beam shock induced deep compressive residual stresses are produced by repetitively firing the laser beam 104, which is defocused±a few mils with respect to the coated suction side surface 55 of the suction side 48 of the compressor blade 108. The laser beam 104 is fired through the curtain of flowing water 121 supplied by a conventional water nozzle 119. The curtain of flowing water 121 is flowed over the coated surfaces. The coating is ablated generating plasma which results in shock waves on the surface of the material. Other ablative materials may be used to coat the surface as suitable alternatives to paint. These coating materials include metallic foil or adhesive plastic tape as disclosed in U.S. Pat. Nos. 5,674,329 and 5,674,328. These shock waves are redirected towards the coated surfaces by the curtain of flowing water 121 to generate travelling shock waves (pressure waves) in the material below the coated surfaces. The amplitude and quantity of these shock waves determine the depth and intensity of compressive stresses. The ablative coating is used to protect the target surface and also to generate plasma. The ablative coating is used to protect the target surface and also to generate plasma. The laser beam shock induced deep compressive residual stresses in the compressive pre-stressed regions are generally about 50–150 KPSI (Kilo Pounds per Square Inch) extending from the laser shock peened surfaces to a depth of about 20–50 mils into the pre-stressed regions continuously.

The compressor blade 108 is moved while the stationary high power laser beams are fired through the curtain of flowing water 121 on the coated suction side laser shock peened surface and forming the spaced apart laser shock peened spots. The movement is done incrementally and stopped at each location where one of the laser spots is to be formed. A controller 124 is used to modulate and control the laser shock peening system 101 to fire the laser beams on the coated surfaces in a controlled manner. Ablated coating material is washed out by the curtain of flowing water 121.

The embodiment of the method of the present invention illustrated herein includes incrementally moving the blade and firing the laser beam on the coated surface and adjacent laser shock peened spots are hit in different sequences. However, the laser beam may be moved instead just so long as relative movement between the beam and the surface is effected. Alternatively, it is contemplated that the blade can be continuously moved while continuously or incrementally firing the laser beam on the coated surface to effect laser shock peening on the fly as disclosed in U.S. Pat. No. 5,756,965, entitled "On the Fly Laser Peening".

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed is:

1. A method for single sided laser shock peening an article, said method comprising:

laser shock peening a laser shock peening surface on a first side of said article while maintaining an opposite second surface on a back side of the article in acoustic communication with a shock attenuating material, the second surface is opposite the laser shock peening surface, and using a shock attenuating material that does not allow tensile waves to be reflected back off the back side through the article.

2. A method as claimed in claim 1 wherein the shock attenuating material is a liquid metal and the article is made from a titanium alloy.

3. A method as claimed in claim 2 wherein the article is a gas turbine engine airfoil.

4. A method as claimed in claim 3 wherein the surfaces are on an edge of the airfoil.

5. A method as claimed in claim 3 wherein the surfaces are on a leading edge of the airfoil.

6. A method as claimed in claim 5 wherein the airfoil is part of an integrally bladed disk.

7. A method as claimed in claim 2 wherein the liquid metal is mercury.

8. A method as claimed in claim 7 wherein the article is a gas turbine engine airfoil.

9. A method as claimed in claim 8 wherein the surfaces are on an edge of the airfoil.

10. A method as claimed in claim 8 wherein the surfaces are on a leading edge of the airfoil.

11. A method as claimed in claim 10 wherein the airfoil is part of an integrally bladed disk.

12. A method as claimed in claim 1 wherein the shock attenuating material is a solid attenuating material.

13. A method as claimed in claim 12 further comprising disposing a liquid metal interface between the article and the solid attenuating material.

14. A method as claimed in claim 13 wherein the article is a gas turbine engine airfoil.

15. A method as claimed in claim 14 wherein the surfaces are on an edge of the airfoil.

16. A method as claimed in claim 15 wherein the surfaces are on a leading edge of the airfoil.

17. A method as claimed in claim 16 wherein the airfoil is part of an integrally bladed disk.

18. A method as claimed in claim 2 wherein the liquid metal interface is mercury.

19. A method as claimed in claim 1 wherein shock attenuating material dissipates compressive waves caused by the laser shock peening.

20. A method as claimed in claim 19 wherein the shock attenuating material is a liquid metal and the article is made from a titanium alloy.

21. A method as claimed in claim 20 wherein the article is a gas turbine engine airfoil.

22. A method as claimed in claim 21 wherein the surfaces are on an edge of the airfoil.

23. A method as claimed in claim 21 wherein the surfaces are on a leading edge of the airfoil.

24. A method as claimed in claim 22 wherein the airfoil is part of an integrally bladed disk.

25. A method as claimed in claim 20 wherein the liquid metal is mercury.

26. A method as claimed in claim 25 wherein the article is a gas turbine engine airfoil.

27. A method as claimed in claim 26 wherein the surfaces are on an edge of the airfoil.

28. A method as claimed in claim 26 wherein the surfaces are on a leading edge of the airfoil.

29. A method as claimed in claim 28 wherein the airfoil is part of an integrally bladed disk.

30. A method as claimed in claim 19 wherein the shock attenuating material is a solid attenuating material.

31. A method as claimed in claim 30 further comprising disposing a liquid metal interface between the article and the solid attenuating material.

32. A method as claimed in claim 31 wherein the article is a gas turbine engine airfoil.

33. A method as claimed in claim 32 wherein the surfaces are on a leading edge of the airfoil.

34. A method as claimed in claim 33 wherein the airfoil is part of an integrally bladed disk.

35. A method as claimed in claim 1 wherein the shock attenuating material reflects back compressive shock waves caused by the laser shock peening through the back side of the article.

36. A method as claimed in claim 19 wherein the article is made from a titanium alloy.

37. A method as claimed in claim 36 wherein the article is a gas turbine engine airfoil.

38. A method as claimed in claim 37 wherein the surfaces are on an edge of the airfoil.

39. A method as claimed in claim 37 wherein the surfaces are on a leading edge of the airfoil.

40. A method as claimed in claim 39 wherein the airfoil is part of an integrally bladed disk.

41. A method as claimed in claim 1 wherein the shock attenuating material is a slurry including a suitable amount of metallic particles mixed with a carrier liquid.

42. A method as claimed in claim 41 wherein the metallic particles are made of a metal chosen from a group of metals including copper, brass, and tungsten.

43. A method as claimed in claim 42 wherein the carrier liquid is a non-corrosive lubricant.

44. A method as claimed in claim 12 further comprising disposing a slurry including a suitable amount of metallic particles mixed with a carrier liquid between the article and the solid attenuating material.

45. A method as claimed in claim 44 wherein the metallic particles are made of a metal chosen from a group of metals including copper, brass, and tungsten.

46. A method as claimed in claim 45 wherein the carrier liquid is a non-corrosive lubricant.

* * * * *